US012305912B2

(12) United States Patent
Li et al.

(10) Patent No.: US 12,305,912 B2
(45) Date of Patent: May 20, 2025

(54) CABINET AND REFRIGERATOR

(71) Applicants: QINGDAO HAIER REFRIGERATOR CO., LTD., Qingdao (CN); HAIER SMART HOME CO., LTD., Qingdao (CN)

(72) Inventors: Xiaofeng Li, Qingdao (CN); Zhanzhan Liu, Qingdao (CN); Peng Li, Qingdao (CN); Zhongliang Xia, Qingdao (CN); Shuai Zhang, Qingdao (CN)

(73) Assignees: QINGDAO HAIER REFRIGERATOR CO., LTD., Qingdao (CN); HAIER SMART HOMES CO., LTD., Qingdao (CN)

( * ) Notice: Subject to any disclaimer, the term of this patent is extended or adjusted under 35 U.S.C. 154(b) by 209 days.

(21) Appl. No.: 18/015,314

(22) PCT Filed: Jul. 22, 2021

(86) PCT No.: PCT/CN2021/107796

§ 371 (c)(1),
(2) Date: Jan. 9, 2023

(87) PCT Pub. No.: WO2022/007973

PCT Pub. Date: Jan. 13, 2022

(65) Prior Publication Data

US 2023/0266052 A1 Aug. 24, 2023

(30) Foreign Application Priority Data

Jul. 9, 2020 (CN) ..... 202010657770.9

(51) Int. Cl.
*F25D 23/06* (2006.01)

(52) U.S. Cl.
CPC ..... *F25D 23/062* (2013.01); *F25D 23/065* (2013.01)

(58) Field of Classification Search
CPC ..... F25D 23/062; F25D 23/066; F25D 23/065
See application file for complete search history.

(56) References Cited

U.S. PATENT DOCUMENTS 5,368,381 A * 11/1994 Mandel ..... F25D 23/082 312/406.2
2007/0001563 A1* 1/2007 Park ..... B29C 44/146 312/406

(Continued)

FOREIGN PATENT DOCUMENTS

CN 104848641 A 8/2015
CN 105466128 A 4/2016

(Continued)

OTHER PUBLICATIONS

English translation of CN 209588488 (Year: 2024).*
English translation of JP 6101957 (Year: 2024).*

*Primary Examiner* — Daniel J Rohrhoff
(74) *Attorney, Agent, or Firm* — Cheng-Ju Chiang

(57) ABSTRACT

The present invention provides a cabinet and a refrigerator. The cabinet comprises a housing, and two inner liners disposed spaced-apart in the housing, spaces between the two inner liners and the housing being different wherein the cabinet further comprises a first stress relief member adhered to an inner side of the housing, and wherein the first stress relief member is located at a position of the housing corresponding to a spacing area between the two inner liners; when the thermal insulation layer undergoes thermal expansion and cold contraction, the first stress relief member can buffer a difference of stresses generated by the thermal insulation layers around the two inner liners to the housing, thereby preventing the housing from deformation.

12 Claims, 3 Drawing Sheets

(56) References Cited

U.S. PATENT DOCUMENTS

| | | | | |
|---|---|---|---|---|
| 2014/0097735 | A1* | 4/2014 | De Bona | F25D 23/08<br>312/406.1 |
| 2016/0258671 | A1* | 9/2016 | Allard | F25D 23/085 |
| 2021/0071942 | A1* | 3/2021 | Ickes | F25D 23/067 |
| 2022/0228795 | A1* | 7/2022 | Harikrishnasamy | F25D 23/082 |
| 2023/0204280 | A1* | 6/2023 | Park | B32B 15/046<br>312/406 |
| 2024/0068739 | A1* | 2/2024 | Yun | F25D 23/066 |

FOREIGN PATENT DOCUMENTS

| | | | | |
|---|---|---|---|---|
| CN | 105927823 | A | | 9/2016 |
| CN | 106196862 | A | | 12/2016 |
| CN | 207247696 | U | | 4/2018 |
| CN | 209588488 | U | | 11/2019 |
| CN | 210135718 | U | | 3/2020 |
| JP | H5-280859 | A | | 10/1993 |
| JP | 6101957 | | * | 4/1994 |
| JP | H6-101957 | A | | 4/1994 |
| JP | H6-201256 | A | | 7/1994 |
| JP | 2013-178071 | A | | 9/2013 |

* cited by examiner

CABINET AND REFRIGERATOR

CROSS REFERENCE TO RELATED APPLICATIONS

The present application is a 35 U.S.C. § 371 National Phase conversion of International (PCT) Patent Application No. PCT/CN2021/107796, filed on Jul. 22, 2021, which claims the priority of Chinese Application No. 202010657770.9 filed on Jul. 9, 2020, the disclosure of which is incorporated by reference herein. The PCT International Patent Application was filed and published in Chinese.

TECHNICAL FIELD

The present invention relates to the field of refrigeration devices, and particularly to a cabinet and a refrigerator capable of preventing a housing from deforming due to thermal expansion and cold contraction of a foaming material.

BACKGROUND

A refrigerator generally comprises a refrigerating compartment and a freezing compartment which are disposed spaced-apart. Specifically, the refrigerator comprises a cabinet, a door body enclosing together with the cabinet to form a refrigerating space. The cabinet comprises a housing, a refrigerating inner liner and a freezing inner liner which are disposed spaced-apart in the housing, and a thermal insulation layer disposed externally around the refrigerating inner line and the freezing inner liner and located in the housing. The refrigerating inner liner and the door body enclose to form the refrigerating compartment, and the freezing inner liner and the door body enclose to form the freezing compartment.

A gap between the freezing inner liner and the housing is greater than the gap between the refrigerating inner liner and the housing, namely, a thickness of the thermal insulation layer between the freezing inner liner and the housing is greater than the thickness of the thermal insulation layer between the refrigerating inner liner and the housing, to ensure the thermal insulation effect of the freezing compartment.

It can be seen that there is a large difference between the thickness of the thermal insulation layer between the freezing inner liner and the housing and the thickness of the thermal insulation layer between the refrigerating inner liner and the housing. When the cabinet is foamed, a foaming material thermally expands and causes the housing to expand. After demolding, the temperature reduces, and the foaming material contracts. The difference in the thickness of the foaming material causes inconsistent contraction. Alternatively, when the refrigerator works normally, the difference in the refrigerating temperatures of the refrigerating compartment and freezing compartment also causes inconsistent contraction of the thermal insulation layers. As a result, deformation such as dimples and wavy wrinkles are prone to occur at the positions of the housing corresponding to the spacing area between the freezing inner liner and the refrigerating inner liner, thereby causing an undesirable appearance of the refrigerator and affecting the product quality and user's experience.

To solve the above problem, in partial conventional cabinets, a reinforcing iron is adhered to the position of the housing corresponding to the spacing area to reinforce the strength of the housing to avoid the deformation of the housing. However, the cost of arranging the reinforcing iron is high, and furthermore, a double-sided adhesive tape is generally employed to adhere the reinforcing iron on the housing. The reinforcing iron has a risk of falling off.

In view of the above, it is necessary to provide a new cabinet and refrigerator to solve the above problem.

SUMMARY

An object of the present invention is to provide a cabinet and a refrigerator capable of preventing a deformation of a housing caused by thermal expansion and cold contraction of a foaming material.

To achieve the above object, the present invention employs the following technical solutions: A cabinet, comprising a housing, and two inner liners disposed spaced-apart in the housing, spaces between the two inner liners and the housing being different; the cabinet further comprises a first stress relief member adhered to an inner side of the housing, and wherein the first stress relief member is located at a position of the housing corresponding to a partition region between the two inner liners.

In another exemplary aspect of the present disclosure, the first stress relief member is a soft foaming member or a soft adhesive tape.

In another exemplary aspect of the present disclosure, a thickness of the first stress relief member is in a range of 0.1 mm-5 mm.

In another exemplary aspect of the present disclosure, a melting point of the first stress relief member is greater than 70° C.

In another exemplary aspect of the present disclosure, a density of the first stress relief member is in a range of 10 $kg/m^3$~30 $kg/m^3$.

In another exemplary aspect of the present disclosure, both ends of the first stress relief member are respectively located on both sides of the partition region along an arrangement direction of the two inner liners.

In another exemplary aspect of the present disclosure, a width of the partition region along the arrangement direction of the two inner liners is h, and distances between the two ends of the first stress relief member along the arrangement direction and the partition region are both not less than h/2.

In another exemplary aspect of the present disclosure, the housing comprises a rear wall and two sidewalls extending forward from the rear wall, and the first stress relief member is arranged on the sidewalls.

In another exemplary aspect of the present disclosure, a length of the first stress relief member in a front-rear direction is the same as the width of the sidewalls in the front-rear direction.

In another exemplary aspect of the present disclosure, the cabinet further comprises an opening, and a partition beam located at the opening and between the two inner liners, and there is a gap between a front end of the first stress relief member and the partition beam.

In another exemplary aspect of the present disclosure, the housing comprises a rear wall and two sidewalls extending forward from the rear wall; the cabinet further comprises a second stress relief member disposed at the partition region and connecting the two inner liners, and the second stress relief member is disposed on a side of the inner liner corresponding to the sidewall.

To achieve the above object, the present invention also provides a refrigerator, wherein the refrigerator comprises the cabinet.

Advantageous effects of the present invention are as follows: in the cabinet in the present invention, the first stress relief member is adhered to the position of the inner side of the housing corresponding to the spacing area between the two inner liners; after the thermal insulation layer is formed by foaming, the first stress relief member is located between the thermal insulation layer and the housing. When the thermal insulation layer undergoes thermal expansion and cold contraction, the first stress relief member can buffer the difference of stresses generated by the thermal insulation layers around the two inner liners to the housing, thereby preventing the housing from deformation.

DETAILED DESCRIPTION

Figure 1:
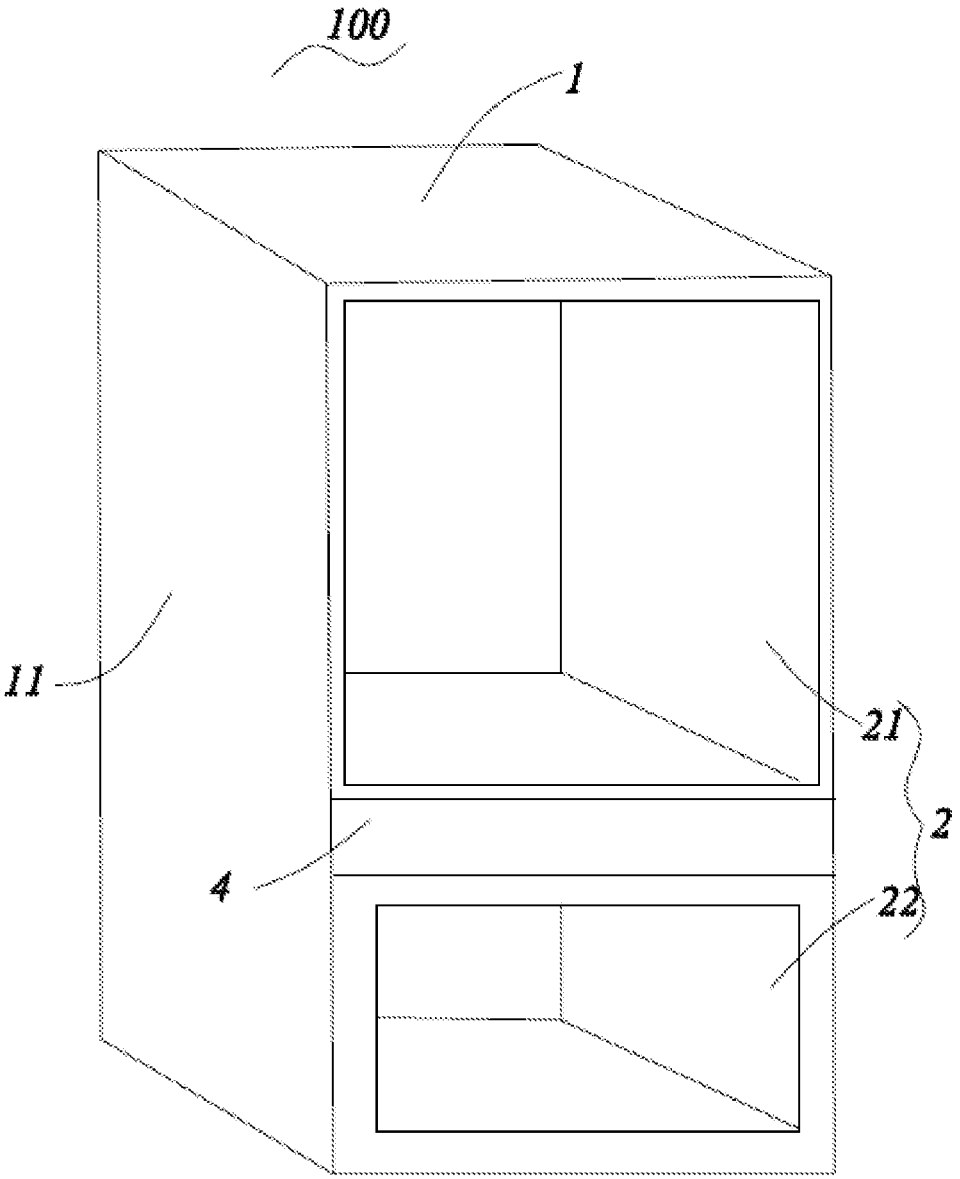
FIG. 1 is a structural schematic view of a cabinet in the present invention.
Figure 2:
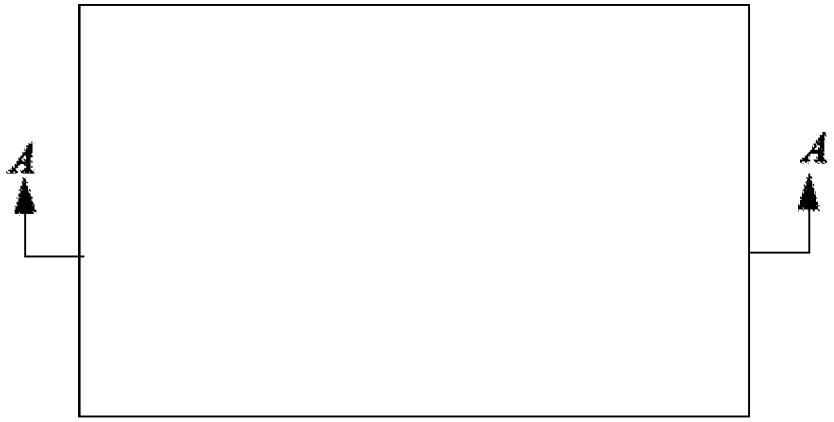
FIG. 2 is a top view of the cabinet shown in FIG. 1.
Figure 3:
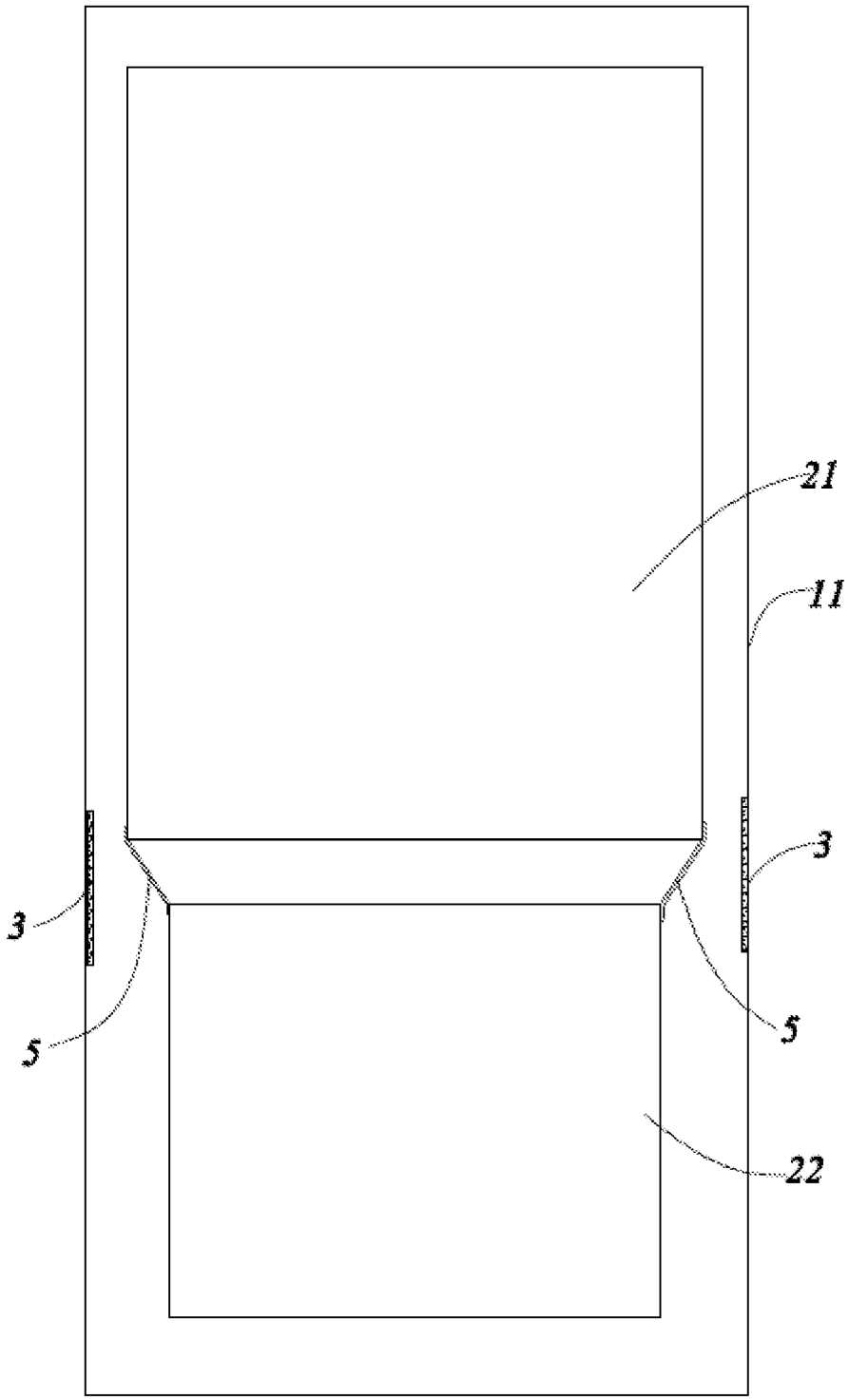
FIG. 3 is a cross-sectional view taken along line A-A in FIG. 2.

The present invention will be described in detail below in combination with embodiments shown in the figures. What are shown in FIG. 1 through FIG. 3 are preferred embodiments of the present invention. However, it should be appreciated that these embodiments are not intended to limit the present invention, and equivalent variations or substitutes in terms of function and methods made by those having ordinary skill in the art according to these embodiments all fall within the protection scope of the present invention.

As shown in FIG. 1 through FIG. 3, the present invention provides a cabinet 100, which comprises a housing 1, and two inner liners 2 disposed spaced-apart in the housing 1, wherein spaces between the two inner liners 2 and the housing 1 are different. The housing 1 has an opening, the two inner liners 2 are sealingly connected with the housing 1 at an edge of the opening, and a foaming cavity is formed between the housing 1 and the two inner liners 2. A liquid foaming material injected into the foaming cavity, solidifies to form a thermal insulation layer. Meanwhile, the housing 1 and the two inner liners 2 are firmly connected together through the thermal insulation layer.

Specifically, one of the two inner liners 2 is a refrigerating inner liner 21, and the other is a freezing inner liner 22. A gap between the refrigerating inner liner 21 and the housing 1 is smaller than the gap between the freezing inner liner 22 and the housing 1. Therefore, a thickness of the thermal insulation layer around the freezing inner liner 22 is greater than the thickness of the thermal insulation layer around the refrigerating inner liner 21, that is, the lower a refrigeration temperature set in the inner liner 2 is, the thicker the thermal insulation layer is, so that a corresponding thermal insulation effect can be achieved.

It may be appreciated that the thickness of the thermal insulation layer corresponding to the freezing inner liner 22 is different from the thickness of the thermal insulation layer corresponding to the refrigerating inner liner 21. When the thermal insulation layer undergoes thermal expansion and cold contraction, they generate different stresses to the corresponding housing 1, i.e., the stresses generated by the corresponding housing 1 are different, which will cause deformation such as wavy wrinkles or dimples at a position of the housing 1 corresponding to a spacing area between the two inner liners 2.

Furthermore, the cabinet 100 further comprises a first stress relief member 3 adhered to an inner side of the housing 1. The first stress relief member 3 is located at a position of the housing 1 corresponding to the spacing area between the two inner liners 2. It may be understood that after the thermal insulation layer is formed by foaming, the first stress relief member 3 is located between the thermal insulation layer and the housing 1. When the thermal insulation layer undergoes thermal expansion and cold contraction, the first stress relief member 3 can buffer a difference of stresses generated by the thermal insulation layers around the two inner liners 2 to the housing 1, thereby preventing the housing 1 from deformation.

In the present embodiment, the first stress relief member 3 is a soft foaming member. After the thermal insulation layer is formed by foaming, the first stress relief member 3 can be closely engaged with the thermal insulation layer to prevent the first stress relief member 3 from separating from the thermal insulation layer, thereby preventing a hollow from occurring at the position of the housing 1 corresponding to the first stress relief member 3 due to the cold contraction of the thermal insulation layer. Meanwhile, when the thermal insulation layer undergoes thermal expansion and cold contraction, the soft first stress relief member 3 can buffer a difference of stresses generated by the thermal insulation layers around the two inner liners 2 to the housing 1, thereby preventing the housing 1 from deformation. Certainly, the first stress relief member 3 is not limited to this. The first stress relief member 3 may also be directly adhered to the inner side of the housing 1 with a soft adhesive tape.

Specifically, in the embodiment in which the first stress relief member 3 is a soft foamed member, the first stress relief member may be selected from a group consisting of a foamed PE member, a foamed PP member, a foamed PVC member, a foamed melamine foam member, a foamed rubber member, etc.

It may be appreciated that when the first stress relief member 3 is a soft foamed member, a double-sided adhesive tape or glue may be used to adhere the first stress relief member 3 to the inner side of the housing 1.

Furthermore, a thickness of the first stress relief member 3 is in a range of 0.1 mm-5 mm, and a thermal conductivity of the first stress relief member 3 is higher than the thermal conductivity of the foaming material forming the thermal insulation layer, i.e., a thermal insulation performance of the first stress relief member 3 is lower than the thermal insulation performance of the foaming material forming the thermal insulation layer. Therefore, limiting the thickness of the first stress relief member 3 can ensure the thermal insulation performance of the cabinet 100, and prevent a large thickness of the first stress relief member 3 from affecting the thermal insulation performance of the cabinet 100.

Furthermore, a melting point of the first stress relief member 3 is greater than 70° C. It may be appreciated that before the foaming material is filled into the foaming cavity, the first stress relief member 3 is first adhered to the inner side of the housing 1, thereby limiting the melting point of the first stress relief member 3 greater than 70° C., which can prevent the foaming material with a higher temperature from contacting the first stress relief member 3 and causing the first stress relief member 3 to melt.

Furthermore, a density of the first stress relief member 3 is in a range of 10 $kg/m^3$~30 $kg/m^3$, ensuring the flexibility of the first stress relief member 3. Thus, when the thermal insulation layer undergoes thermal expansion and cold contraction, the first stress relief member 3 can well buffer the difference of the stresses generated by the thermal insulation layers around the two inner liners 2 to the housing 1, thereby preventing the housing 1 from deformation.

It may be appreciated that if the density of the first stress relief member 3 is larger, the flexibility of the first stress relief member 3 is poor and the first stress relief member 3 cannot achieve the desired effect of buffering the difference of stresses; if the density of the first stress relief member 3 is smaller, the first stress relief member 3 is lighter and internal foam holes are larger. Upon receiving the stress from the thermal insulation layer, the first stress relief member 3 is prone to being broken, which causes failure.

Furthermore, both ends of the first stress relief member 3 are respectively located on both sides of the spacing area along an arrangement direction of the two inner liners 2, so that the housing 1 close to the spacing area is not prone to deform, that is, when the thermal insulation layer undergoes thermal expansion and cold contraction, the first stress relief member 3 can also buffer the difference of stresses generated by the difference of thicknesses between the thermal insulation layer of the spacing area and the thermal insulation layers of the inner liners 2 to the housing 1, thereby enlarging a range of the action of the first stress relief member 3 and further preventing the housing 1 from deforming.

Specifically, a width of the spacing area along the arrangement direction of the two inner liners 2 is h, and distances between the two ends of the first stress relief member 3 along the arrangement direction and the spacing area are both not less than h/2.

Furthermore, the cabinet 100 further comprises a partition beam 4 located at the opening and between the two inner liners 2. There is a gap between a front end of the first stress relief member 3 and the partition beam 4, so that the first stress relief member 3 will not block the foam holes on the partition beam 4. Upon foaming, the foam can flow smoothly into the partition beam 4 and solidify to form the thermal insulation layer, thereby ensuring the thermal insulation effect of the partition beam 4.

It may be appreciated that the width of the partition beam 4 along the arrangement direction of the two inner liners 2 is generally set to be consistent with the width of the spacing area.

Specifically, the housing 1 comprises a rear wall and two sidewalls 11 extending forward from the rear wall. The two inner liners 2 are arranged spaced-apart in a length extension direction of the sidewalls 11. The first stress relief member 3 is arranged on the sidewalls 11. When the thermal insulation layer undergoes thermal expansion and cold contraction, the first stress relief member 3 can buffer the difference of stresses generated by the thermal insulation layers around the two inner liners to the sidewalls 11, thereby preventing the deformation of the sidewalls 11 easily visible by the user; certainly, the position of the first stress relief member 3 is not limited to this. In other embodiments, the first stress relief member 3 can also be synchronously disposed at a position of the rear wall corresponding to the spacing area.

Furthermore, the length of the first stress relief member 3 in a front-rear direction is the same as the width of the sidewalls 11 in the front-rear direction, so that the sidewalls 11 will not deform in the front-rear direction, and the user's experience in use can be enhanced.

In a specific embodiment, the two inner liners 2 are disposed spaced-apart in an up-down direction. It may be appreciated that at this time, the two sidewalls 11 refer to a left sidewall and a right sidewall respectively; Certainly, the present invention is not limited to this in this regard.

Furthermore, the cabinet 100 further comprises a second stress relief member 5 disposed at the spacing area and connecting the two inner liners 2. The second stress relief member 5 is disposed on a side of the inner liner 2 corresponding to the sidewall 11. It may be understood that the second stress relief member 5 partitions the thermal insulation layer of the spacing area from other thermal insulation layers, so that the second stress relief member 5 can buffer a stress generated by inconsistent contraction of the thermal insulation layer of the spacing area due to a large difference of temperatures of the two inner liners 2, and so that the stress generated by inconsistent contraction of the thermal insulation layer of the spacing area due to the large difference of temperatures of the two inner liners 2 will not be transferred to the thermal insulation layer at other positions, thereby further preventing the housing 1 from deformation.

Except for the position, the second stress relief member 5 may employ corresponding features of the first stress relief member 3 in other aspects such as the material, thickness, density, melting point and adhesion manner. Detailed depictions are not presented any more here.

Furthermore, the invention further provides a refrigerator. The refrigerator comprises the cabinet 100 described above. The structure of the cabinet 100 has been described in detail above, and will not be described in detail here any longer. Meanwhile, except for the cabinet 100, other structures of the refrigerator may employ the structures of the conventional refrigerator, and will not be described in detail here any longer.

To conclude, in the cabinet 100 in the present invention, the first stress relief member 3 is adhered to the position of the inner side of the housing 1 corresponding to the spacing area between the two inner liners 2; after the thermal insulation layer is formed by foaming, the first stress relief member 3 is located between the thermal insulation layer and the housing 1. When the thermal insulation layer undergoes thermal expansion and cold contraction, the first stress relief member 3 can buffer the difference of stresses generated by the thermal insulation layers around the two inner liners 2 to the housing 1, thereby preventing the housing 1 from deformation.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A cabinet, comprising a housing, and two inner liners disposed spaced-apart in the housing, spaces between the two inner liners and the housing being different;

wherein the cabinet further comprises a first stress relief member adhered to an inner side of the housing, and wherein the first stress relief member is located at a position of the housing corresponding to a spacing area between the two inner liners, and is spaced away from both of the two inner liners.

2. The cabinet according to claim 1, wherein the first stress relief member is a soft foaming member or a soft adhesive tape.

3. The cabinet according to claim 2, wherein a thickness of the first stress relief member is in a range of 0.1 mm-5 mm.

4. The cabinet according to claim 2, wherein a melting point of the first stress relief member is greater than 70° C.

5. The cabinet according to claim 2, wherein a density of the first stress relief member is in a range of 10 $kg/m^3$~30 $kg/m^3$.

6. The cabinet according to claim 1, wherein both ends of the first stress relief member are respectively located on both sides of the spacing area along an arrangement direction of the two inner liners.

7. The cabinet according to claim 6, wherein a width of the spacing area along the arrangement direction of the two inner liners is h, and distances between the two ends of the first stress relief member along the arrangement direction and the spacing area are both not less than h/2.

8. The cabinet according to claim 1, wherein the housing comprises a rear wall and two sidewalls extending forward from the rear wall, and the first stress relief member is arranged on the sidewalls.

9. The cabinet according to claim 8, wherein a length of the first stress relief member in a front-rear direction is the same as the width of the sidewalls in the front-rear direction.

10. The cabinet according to claim 1, wherein the cabinet further comprises an opening, and a partition beam located at the opening and between the two inner liners, and there is a gap between a front end of the first stress relief member and the partition beam.

11. The cabinet according to claim 1, wherein the housing comprises a rear wall and two sidewalls extending forward from the rear wall; the cabinet further comprises a second stress relief member disposed at the spacing area and connecting the two inner liners, and the second stress relief member is disposed on a side of the inner liner corresponding to the sidewall.

12. A refrigerator, wherein the refrigerator comprises the cabinet according to claim 1.

* * * * *